United States Patent [19]

Schmitt

[11] 4,128,148

[45] Dec. 5, 1978

[54] BRAKE RIGGING FOR DROPPED BOTTOM GONDOLA CARS

[75] Inventor: Eugene W. Schmitt, Lockport, Ill.

[73] Assignee: Harbil, Inc., Chicago, Ill.

[21] Appl. No.: 857,300

[22] Filed: Dec. 5, 1977

[51] Int. Cl.[2] ..... F16D 65/62

[52] U.S. Cl. ..... 188/197; 188/52

[58] Field of Search ..... 188/52, 196 D, 197, 188/202, 203

[56] References Cited

U.S. PATENT DOCUMENTS

| | | | |
|---|---|---|---|
| 3,337,011 | 8/1967 | Billeter | 188/197 |
| 3,378,112 | 4/1968 | Roselius et al. | 188/197 |
| 3,543,889 | 12/1970 | Roselius et al. | 188/197 |

*Primary Examiner*—Duane A. Reger

*Attorney, Agent, or Firm*—McWilliams & Mann

[57] ABSTRACT

A brake rigging arrangement for high capacity dropped bottom gondola cars of the curved bottom type in which each end of the car up to the dropped bottom is in the form of a planar shear plate that is coextensive with the car end and is highly stressed under load, and is integrated with a stub center sill and body bolster, in which arrangement the rigging is of the double ended car supported type, and at each end of the car, the rigging for that end of the car is applied entirely below the shear plate in question and is integrated with the car end stub center sill at the level of the stub center sill without requiring perforation of the shear plate in the load bearing area of the car end. The rigging components include a cylinder lever and an adjusting floating lever extending crosswise of the car and operating partially within the center sill; the rigging components are located adjacent the level of the center sill neutral axis to minimize reinforcement needs, and a slack adjuster mounting arrangement is included that adjusts the live end of the rigging for slack occasioned by brake shoe wear, loss, and replacement.

7 Claims, 11 Drawing Figures

FIG. 5
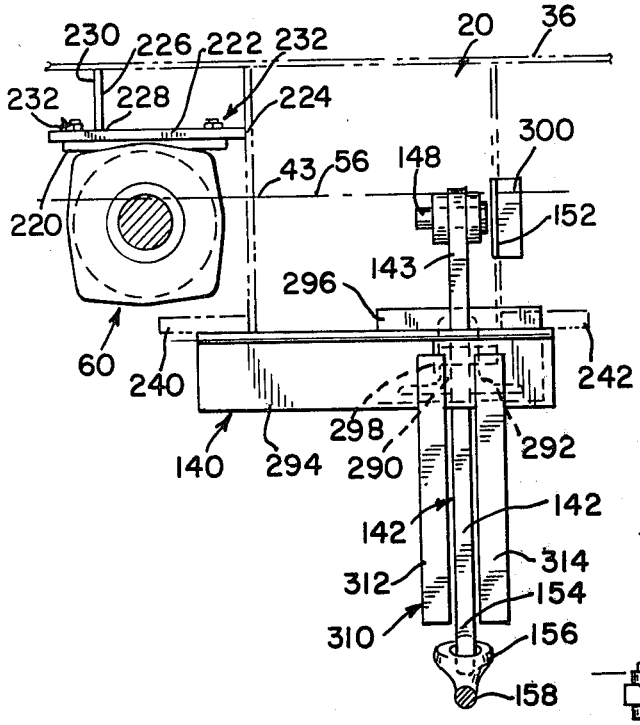
FIG. 6
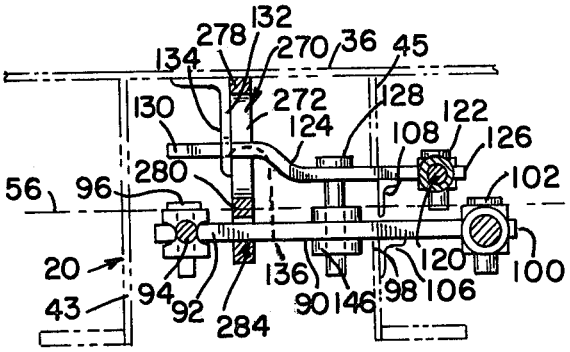
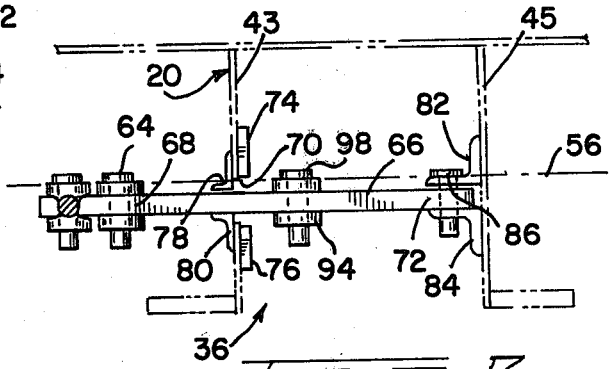
FIG. 7
FIG. 8
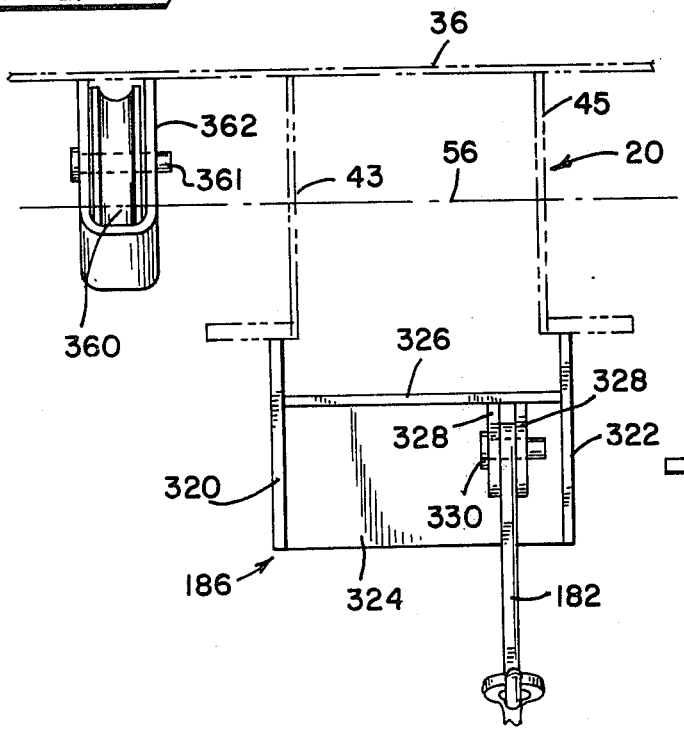
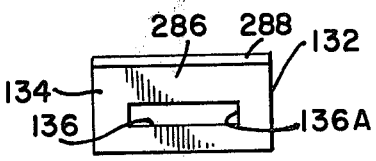
FIG. 6A
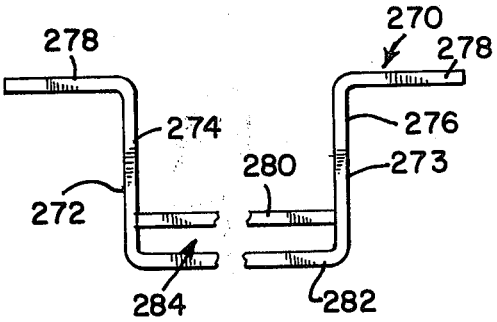
FIG. 6B

BRAKE RIGGING FOR DROPPED BOTTOM GONDOLA CARS

This invention relates to a brake rigging arrangement for high capacity gondola cars of the rounded dropped bottom type, and more particularly, to a brake rigging of the double ended type arranged for car supported application at the respective ends of the car.

The invention is specifically concerned with a double ended brake rigging arrangement for application to dropped bottom gondola cars of the type disclosed in Teoli U.S. Pat. No. 3,713,400, granted Jan. 30, 1973 (the entire disclosure of which is hereby incorporated herein by this reference). Cars of this type have a parabolic shaped dropped bottom that extends between the trucks of the car for increased capacity with reduced center of gravity characteristics. Cars of this type are normally equipped with truck mounted brake rigging as the dropped bottom of the car body is too low to accommodate standard car body supported rigging applications.

However, conventional truck mounted brake rigging has operational limitations that have warranted innovative efforts to provide cars of this type with the benefits of car supported rigging, such as rigging slack adjustment to accommodate brake shoe wear, loss, and replacement.

Gondola cars of the type disclosed in said Teoli patent lack the usual underframe and instead have integrated with the dropped bottom at each end of the car a planar horizontally disposed shear plate that is in turn integrated with a stub center sill and body bolster; the shear plate in question is coextensive with the load bearing area of the car body end beyond the dropped bottom and extends to the end of the car beyond the car end wall, and is highly stressed when the car is loaded. Due to the high stressing of the shear plates at the car ends when the car is loaded, it is important that operating equipment such as brake rigging for the car can be arranged to avoid having to perforate the shear plates in question in providing for application of the rigging equipment to the car, if expensive and troublesome reinforcement provision is to be avoided.

The car in question in a commercialized form made by Youngstown Steel Door Co. has a 4,220 cubic foot capacity with an empty weight of only 52,000 pounds. The usual underframe is eliminated, and a nominal 105 ton capacity is provided. As the bottom is dropped below the level of the truck axles, it is not possible to apply conventional rigging to the dropped bottom.

A principal object of this invention is to provide a brake rigging arrangement of the double ended type for car body supported application, and specifically for application to rounded dropped bottom gondola cars of the special type indicated.

Another principal object of the invention is to provide a brake rigging arrangement of the double ended type for dropped bottom gondola cars in which the rigging components at each end of the car are integrated with the car end stub center sill and below the overlying stress plate, with those components requiring perforation of the center sill side plates being disposed approximately at the level of the center sill neutral axis for minimized reinforcing requirements for the center sill.

Another important object of the invention is to provide a double ended car body supported brake rigging arrangement in which the slack adjustment is at or adjacent the live end of the rigging for maintaining operating angles of the levers involved at maximum efficiency.

Other objects of the invention are to provide a brake rigging arrangement of the double ended type for dropped bottom gondola cars that is car body supported in application and is operably integrated with the car end stub center sill without requiring aperturing of the car end stress plate within the lading load bearing area of same, that has its components located for minimizing reinforcement needs of the center sill, and that is economical of manufacture, convenient to install, and long lived in operation.

In accordance with the invention, a double ended brake rigging arrangement is provided specifically for application to rounded dropped bottom gondola cars of the type disclosed in said Teoli patent, in which, at each end of the car, and below the car end shear plate, all of the rigging components operated by the brake cylinder are applied in integrated relation with the car end stub center sill, and at the level of same, within and on either side of the center sill. At each such car end, between the dropped bottom and the body bolster, the brake cylinder, the cylinder lever, a slack adjuster, a control or trigger lever for operating same, and a floating adjusting lever are mounted, with the brake cylinder thrust rod, the cylinder lever, the slack adjuster and its control lever, and the floating lever being disposed at levels adjacent the level of the center sill neutral axis.

The brake cylinder is mounted adjacent the car dropped bottom on one side of the stub center sill with its thrust rod paralleling the center sill and extending toward the body bolster at that end of the car. The cylinder lever extends crosswise of the center sill and within the center sill, the outer end of same being pivoted to the brake cylinder thrust rod and its inner end being swingably connected within and to the other side of the center sill.

The floating adjusting lever is mounted between the cylinder lever and the dropped bottom and extends crosswise of the center sill; it extends from within the center sill, where its inner end is pivotally connected to the cylinder lever by a cylinder lever rod, to and through the other side of the center sill adjacent to where the slack adjuster is mounted, and where its outwardly protruding end is pivotally connected or fulcrumed to the slack adjuster. The slack adjuster preferably is of the type disclosed in Billeter U.S. Pat. No. 3,669,224, granted June 13, 1972 (the entire disclosure of which is hereby incorporated herein by this reference), and the floating lever is connected to one of the adjuster telescoping members, while the adjuster other telescoping member extends toward and through the body bolster the body bolster at that end of the car for anchoring to the center sill.

Pivotally mounted within the center sill and between the floating lever and the dropped bottom is a vertical lever having its upper end within the center sill and connected to the floating lever intermediate the ends of the latter by a center rod. The lower end of the vertical lever is connected by a conventional hook and eye brake rigging arrangement with the usual car body supported brake beams in an under the axle application that is anchored at the outer end of the stub center sill.

The slack adjuster trigger lever is applied to the stub center sill in overlying relation to the floating adjusting lever for connection to the adjuster trigger rod at the end of the trigger lever that projects exteriorily of the center sill for that purpose. The other or inner end of the trigger lever rides in the usual differential movement providing control bracket that in this instance is fixed within the center sill, while the trigger lever is pivotally connected intermediate its end to the floating lever at the pivot axis that the aforementioned center rod makes therewith.

The result is that thrust forces provided by the brake cylinder on actuation of same operate longitudinally of the center sill, with the thrust force provided by the brake cylinder thrust rod being directed toward the body bolster at that end of the car, which force is transmitted by a cylinder lever to the adjusting lever to in turn apply thrust forces operating in the same direction on the upper end of the vertical lever that translates the thrust forces to move in the opposite direction in actuating the conventional hook and eye brake operating linkage of the under the axle type that is employed to transmit the braking forces to the brake shoes. During each braking stroke, the slack adjuster shifts the adjusting lever fulcrum forming connection to the slack adjuster toward and away from the body bolster at that end of the car to adjust rigging slack for brake shoe wear, loss, and replacement.

Provision is also made for setting of the brakes with the usual hand brake.

Other objects, uses, and advantages will be obvious or become apparent from a consideration of the following detailed description and the application drawings in which like parts are indicated by like reference numerals throughout the several views.

In the drawings:

FIG. 1 is a diagrammatic side elevational view of a car of the type disclosed in said Teoli patent, shown equipped with a double ended brake rigging arrangement in accordance with the present invention;

FIG. 2 schematically illustrates the brake linkage arrangement at each end of the car;

FIG. 5 is a fragmental sectional view taken substantially along line 5—5 of FIG. 4, better illustrating the orientation of the brake cylinder and vertical lever with respect to the car stub center sill and overlying shear plate;

FIG. 6 is a fragmental sectional view taken substantially along line 6—6 of FIG. 3, better illustrating the orientation of the rigging floating lever, slack adjuster, and control or trigger lever therefor, with respect to the stub end sill and overlying shear plate;

FIG. 6A is an elevational view of the adjuster trigger lever control bracket;

FIG. 6B is a side elevational view of the floating adjusting lever carrier;

FIG. 7 is a fragmental sectional view taken substantially along line 7—7 of FIG. 3, better illustrating the orientation of the cylinder lever with respect to the stub center sill and overlying shear plate;

Figure 9:
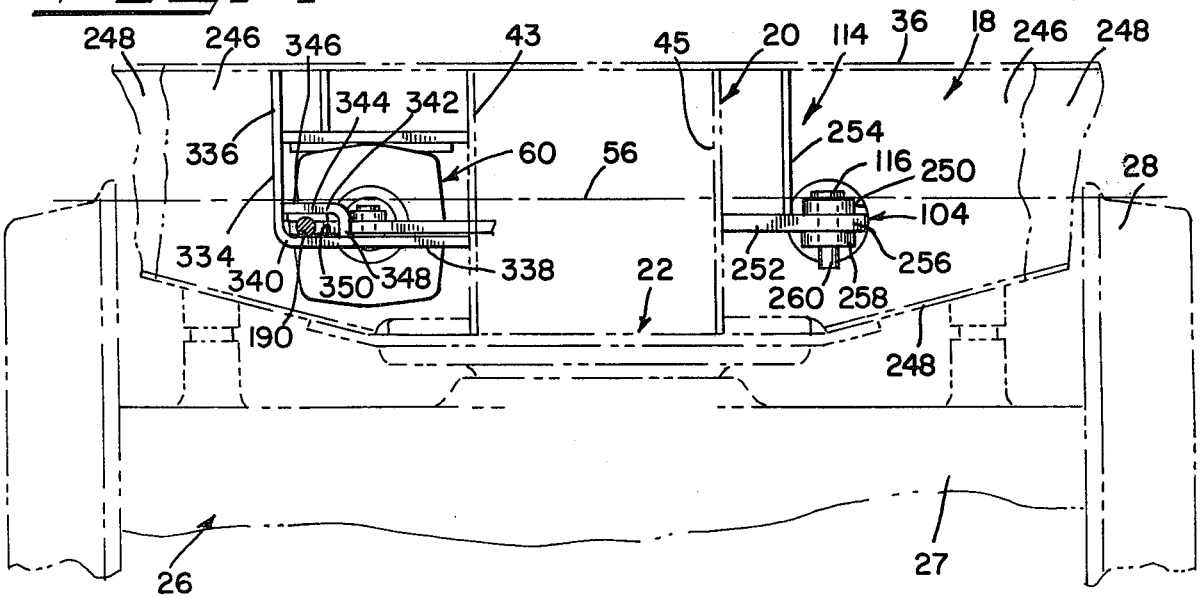
Figure 3:
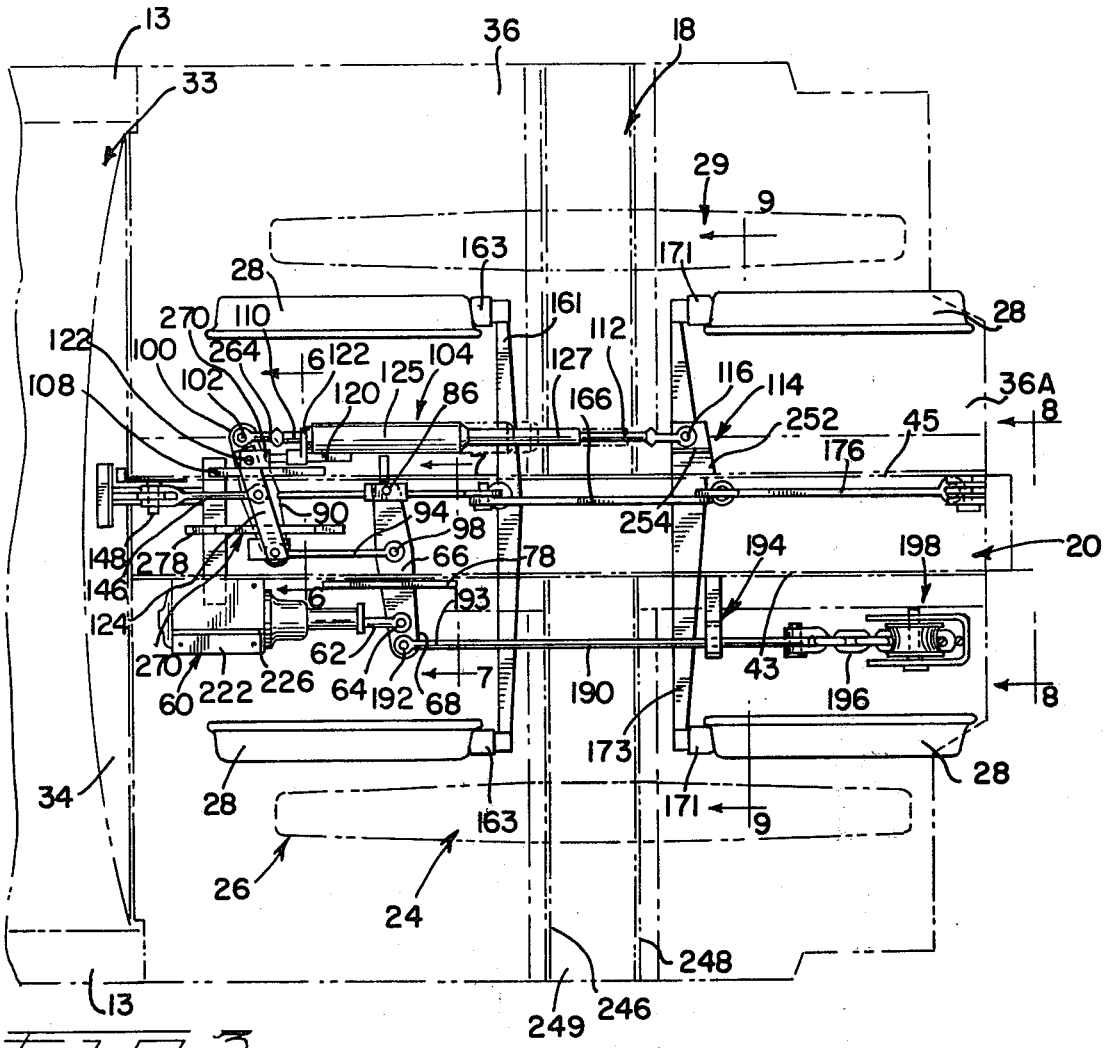
FIG. 3 is a fragmental plan view of the right hand or "B" end of the car shown in FIG. 1, on an enlarged scale, and showing the brake rigging components in full line illustration and the associated car structural features in phantom.
Figure 4:
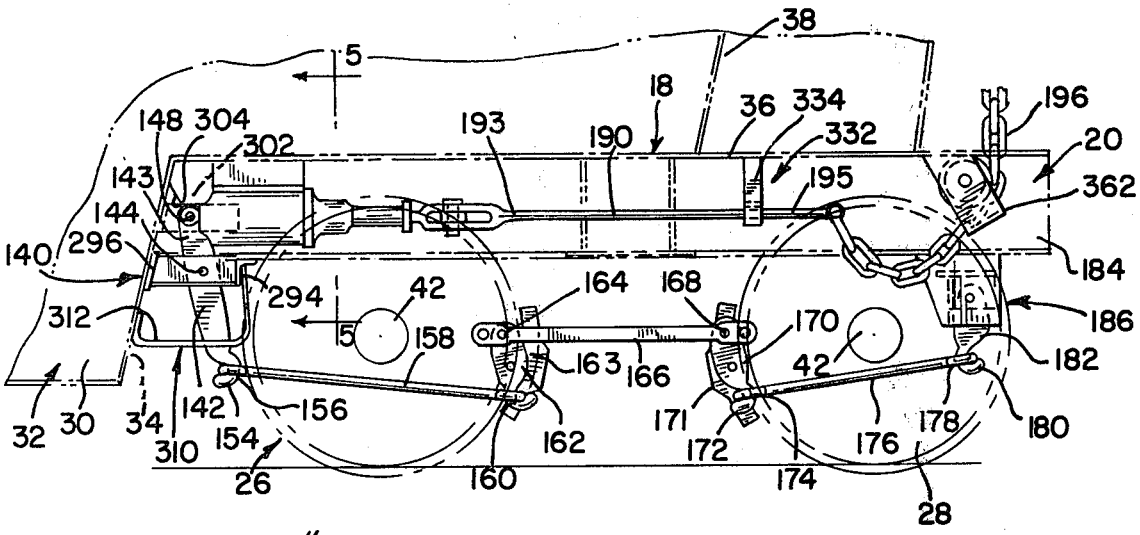
FIG. 4 is a side elevational view of the structural features shown in FIG. 3, taken from the bottom side of FIG. 3.

FIG. 8 is a fragmental sectional view taken substantially along line 8—8 of FIG. 3, illustrating the orientation of the anchored end of the brake rigging with respect to the stub end sill and overlying shear plate; and FIG. 9 is a fragmental sectional view substantially along line 9—9 of FIG. 3 that supplements the showings of FIGS. 4 and 6 with regard to the orientation of the slack adjuster and brake cylinder with respect to the stub center sill end shear plate, and showing additional structural parts of the car in phantom.

However, it is to be distinctly understood that the specific drawing illustrations provided are supplied primarily to comply with the requirements of the Patent Laws, and that the invention is susceptible of other embodiments that will be obvious to those skilled in the art, and that are intended to be covered by the appended claims.

GENERAL DESCRIPTION

Figure 1:
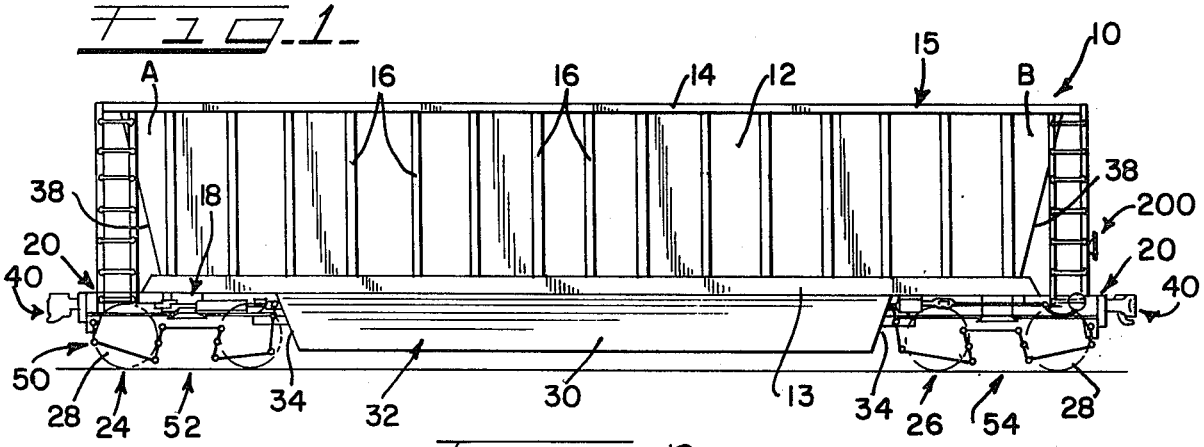

Reference numeral 10 of FIG. 1 generally indicates a dropped bottom gondola car of the type disclosed in said Teoli patent, diagrammatically illustrating its converging side panels 12 that at the top of the car are secured to box section stringers 14 and at the bottom to box section side sills 13, with suitable brace members 16 extending between the stringer 14 and side sill 13 on either side of the car.

At the respective ends of the car, the side sills 13 are seated upon the respective body bolsters 18 that are integrated with the respective stub center sills 20, each of which is provided with the usual center plate construction 22 (see FIG. 9 for mounting the respective car ends on the respective trucks 24 and 26 in the usual and conventional manner. The trucks 24 and 26 are equipped with the usual truck bolsters 27 and side frames 29 supported by wheels 28 that ride on track rails that are not shown.

As disclosed in said Teoli patent, between the trucks 24 and 26 a bottom sheet 30 in the form of a parabolic curve (transversely of the car) is affixed to define the dropped bottom 32. The pocket 33 (see FIG. 3) formed by the bottom sheet 30 is closed at the ends of the pocket by sloping sheets 34 suitably welded in place.

At the respective ends of the car, each end of the car is equipped with a horizontally disposed, substantially planar shear plate 36 that form the floor of the car body 15 at its ends and underlie and form the load bearing surface for the portion of the lading load that fills the space within the respective car ends over the stub center sills. The car body ends are closed by suitable downwardly converging panels 38 suitably affixed to the side panels by welding and suitably reinforced. The car 10 is provided in any suitable manner with rotary couplers 40 suitably arranged for unloading of the car in a positioner-dumper unit train facility. Cars of the type indicated are particularly suitable for use in unit coal trains.

As indicated in the drawings, the drop bottom 32 projects below the level of the truck wheel axles 42, and thus the car body 15 has been generally considered unsuitable for application thereto of body supported brake rigging. Consequently, it has been general practice to equip the car 10 with truck mounted rigging that has the aforementioned operational deficiency with regard to accommodating the adverse effects of brake shoe wear loss and replacement on operation of the brake rigging.

Figure 2:
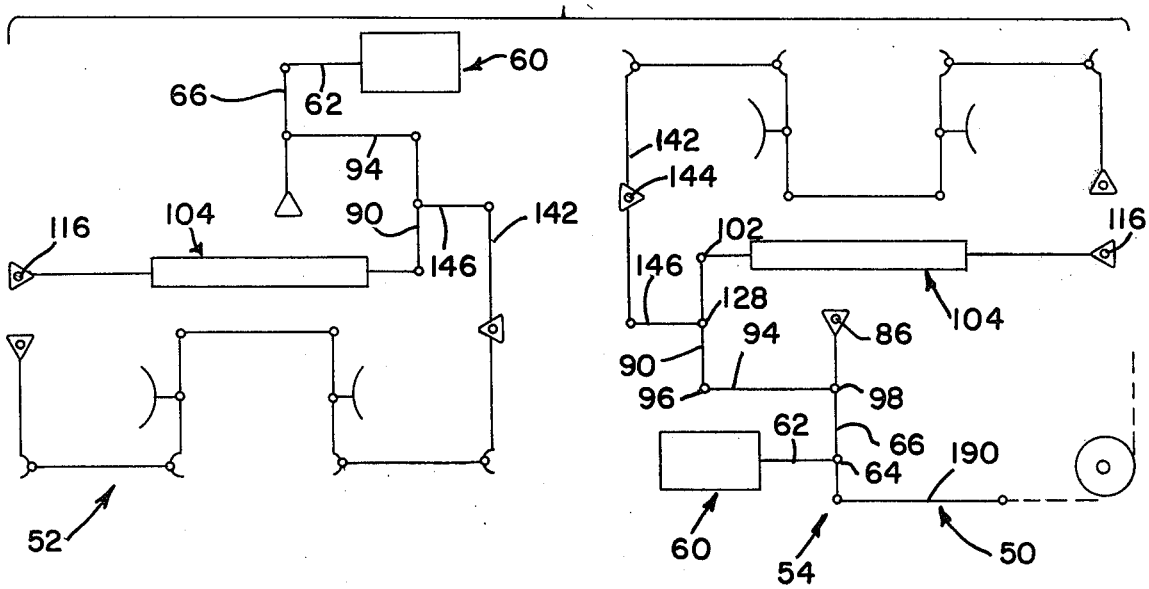

In accordance with the invention, the car 10 is equipped with a brake rigging 50 of the double ended type schematically outlined in FIG. 2, comprising a rigging assembly 52 at the A end of the car and a rigging assembly 54 at the B end of the car. As the rigging assemblies 52 and 54 are essentially the same but oppositely disposed at the respective ends of the car, only the rigging assembly 54 is illustrated in detail, it being understood that the structural features of the rigging assembly 52 are the same but arranged to have the orientation indicated in FIG. 9, except as specifically pointed out hereinafter.

Further in accordance with the invention, the rigging assemblies 52 and 54 are integrated with the stub center sills 20 at the respective ends of the car, in the manner indicated in the drawings, with the arrangement being such that the various components of the brake rigging assemblies 52 and 54 are mounted in operating position to avoid aperturing of the shear plates 36 in the lading load bearing areas of same; also the components involved that are integrated with the respective stub center sills 20 are applied adjacent the level of the neutral axis 56 of the respective stub center sills.

The respective brake rigging assemblies 52 and 54 each comprise a brake cylinder 60 of the usual type suitable for air operated brake rigging that includes the usual thrust rod 62 pivotally connected by suitable pin 64 to cylinder lever 66 adjacent its end 68.

It will be noted that the brake cylinder 60 is mounted to one side of the stub center sill 20, for instance adjacent its side plate 43.

The brake cylinder 60 is disposed between the dropped bottom end plate 34 at that end of the car and the body bolster 18, and projects in the direction of the body bolster 18 for pivotal connection to the cylinder lever 66, as at 64, adjacent the cylinder lever end portion 68.

As indicated in FIGS. 3 and 7, the cylinder lever 66 extends crosswise of the car, and projects into the stub center sill 36 through elongate window opening 70 formed in the stub sill side wall 43, for pivotal connection on its end 72 to the opposing stub center sill side wall 45. As also indicated in FIGS. 3 and 7, the window opening 70 is suitably reinforced above and below same by upper and lower plates 74 and 76 suitably mounted in place (as by welding), and is movement guided by the respective upper and lower angle members 78 and 80 that extend longitudinally of the window opening 70 for this purpose. The cylinder lever end 72 is pivotally connected to the stub center sill wall 45 by having said end 72 swingably received between the respective angle bracket members 82 and 84 and pivotally connected to same by suitable pin 86.

Mounted between the cylinder lever and the dropped bottom end plate is floating lever 90 that has its end 92 pivotally connected to the cylinder lever intermediate the ends of the latter, as by using cylinder lever rod 94 and pivot pins applied thereto where indicated at 96 and 98. The floating lever 90 also extends crosswise of the car and projects through window opening 98 formed in the stub center sill side wall 45 (see FIG. 6) to present its end 100 exteriorily of the stub center sill 20 for making the fulcrum pivotal connection 102 to slack adjuster 104 that is mounted exteriorily of the stub center sill 20 and in parallelism therewith in the manner diagrammatically indicated in FIGS. 3, 6 and 9.

The window opening 98 is provided with movement guiding members 106 and 108 suitably fixed to sill side 45 (as by welding) that guide the movement of the floating lever 90 during the course of operation of the rigging.

The brake adjuster 124 comprises a pair of telescoping member 110 and 112, with the member 110 being fulcrumed to the end 100 of the floating lever 90 (at fulcrum 102) and the member 112 being pivotally connected to the stub center sill, as by employing suitable bracket structure 114 and suitable pivotal connection 116.

The brake adjuster 104, which is embodied in a commercial device of this type made and sold by the Railroad Products Division of Sloan Valve Co., includes the familiar trigger rod 120 that is pivotally connected as at 122 to control or trigger lever 124, adjacent its end 126. Trigger rod 120 carries trigger bracket 123 that is fixed to rod 120 for engagement with trigger housing 125 that is operably carried by adjuster member 110, as disclosed in said Billeter U.S. Pat. No. 3,669,224. Housing 125 has an extension 127 for pivoting the threaded portion of adjuster member 112.

The trigger or control lever 124 extends inwardly of the stub center sill 20 through window opening 98, and over the upper guide member 108, for pivotal connection to the floating lever 90 that is provided by suitable pin 128. The trigger or control lever 124 at its end 130 is applied to the usual differential movement providing bracket 132 secured by welding to the underside of shear plate 36 and having its depending flange 134 formed with the usual operating slot 136 through which the trigger lever or arm 124 extends.

Pivotally mounted between the floating lever 90 and the dropped bottom end plate 34, on mounting frame 140, is vertical lever 142 that pivots about horizontal axis 144. The vertical lever upper end 143 is connected to the floating lever 90 by way of center rod 146 that is pivotally connected to the floating lever 90 by pin 128, and that is pivotally connected to the vertical lever 142 by pin 148.

As indicated in FIG. 5, the vertical lever 142 is mounted to have its upper end 143 disposed within the level of the stub center sill. The movement of pin 148 is guided by guide plate 152 affixed to and between the dropped bottom end plate 34 and the center sill side plate 45.

The vertical lever 142 in application is of the type employed in hook and eye brake arrangements, its lower end 154 being hooked for engagement with the eye 156 of connecting rod 158 that has its other eye 160 pivotally connected to conventional truck live lever 162, the other end of which is pivotally connected as at 164 to connecting rod 166 that is in turn pivotally connected as at 168 to the truck dead lever 170 which in turn has its end portion 172 pivotally connected to the looped end 174 of anchor rod 176 having its looped end 178 pivotally connected to end 180 of anchor lever 182 that is pivotally connected to the stub center sill adjacent its outer end 184, as by employing bracket structure 186.

The truck live and dead levers 162 and 170 are arranged in any conventional manner and are suitably supported from the truck employing the usual swing arms that are not shown. Levers 162 and 170 are suitably connected to the usual brake beams 161 and 173 controlled thereby, the beams respectively mounting the usual brake shoes 163 and 171 for application to wheels 28 (these parts being shown largely in block diagram form as they are entirely conventional).

As indicated in FIGS. 3 and 4, the cylinder lever 66 at the B end of the car has connected thereto hand brake connecting rod 190, as by employing suitable pin 192 at its end 193, with the other end 193 of the rod 190 being supported in suitable guide structure 194 and connected to flexible member 196 suitably trained over pulley device 198 for application to a conventional form of hand brake 200 (see FIG. 1).

As indicated, the component parts of the rigging assembly 52 are the same as those of assembly 54, with the positional differences involved diagrammatically illustrated in FIG. 2, it being understood that the stub center sill 20 at the A end of the car and associated parts are arranged in a manner comparable to the corresponding parts shown in FIGS. 1 and 3–9. The brake cylinder 60 of both rigging assemblies are suitably incorporated in a conventional air brake apparatus for simultaneously operating the brake cylinder 60 in the usual brake cylinder operating manner.

The description of operation that follows is concerned specifically with the rigging assembly 54 as this is the assembly that has been specifically illustrated. However, it is to be understood that the operation of the rigging assembly 52 is similar but in an opposite manner consistent with the orientation of the components of assembly 52 with respect to the corresponding components of assembly 54.

In the showing of FIGS. 3–9, the brake rigging assembly components illustrated are shown at approximately their riding positions for the condition when the car brake shoes are new, with the brake rigging having been actuated to dispose the slack adjuster 104 in its position of maximum let out (the full line position of FIG. 3).

When braking of the car 10 is to be effected, the brake cylinders 60 are actuated to move their thrust rods 62 in the usual manner against the respective cylinder levers 66.

The brake cylinder 60 of assembly 54 in operating its cylinder lever 66 through thrust rod 62 swings the cylinder lever 66 counterclockwise to the right of FIG. 3 about its pivot pin 86 thereby swinging the floating adjusting lever 90 about the adjusting fulcrum 102, with the adjusting lever 90 also being swung counterclockwise to the right of FIG. 3, and through the brake rod 146, swinging vertical lever 142 clockwise about its pivot axis 144 to provide the needed thrust on brake rods 158, 166 and 176 for bringing brake shoes 163 and 171 against the truck wheels 28 in the usual manner.

As the adjusting lever 90 moves to the right of FIG. 3 in a counterclockwise direction about its fulcrum 102, the trigger or control lever 124 moves with it in a similar direction about its pivotal connection 122 to the adjuster trigger rod 120, due to the pivotal connection that control lever 124 has with the adjusting lever 90 and pivot pin 128. This movement continues to the extent permitted by slot 136 of control bracket 132, which is proportioned such that the swinging movement of the control lever 124 ceases when the brake shoes engage the truck wheels, lever having by then engaged the end 136A of slot 136 (see FIG. 6A). Thereafter, during the braking stroke, control lever 124 remains stationary (as the trigger bracket 132 is in fixed relation to the car body) to set up the slack adjust components for slack take up. As the brake stroke continues and stresses mount up in the linking assemblies involved, the adjusting lever fulcrum 102 moves to the left of FIG. 3, about the new stationary pivot axis defined by pin 128, moving the adjuster telescoping member 110 with it to condition adjuster 104 for slack take up.

On release, the brake beams 161 and 173 drop away from the wheels in the usual manner and the rigging components return to their initial positions, with the slack adjuster 104 functioning to return fulcrum 102 to its initial starting position that will maintain the stroke of the brake cylinder thrust rods within the optimum movement range of 7 to 9 inches. In doing this, the brake adjuster member 112 telescopes inside the brake adjuster member 110 in the manner disclosed in said U.S. Pat. No. 3,669,224. As the brake shoes wear and operations of the rigging are repeated, the brake adjuster components advance to the right of FIG. 3 to the position indicated in broken lines, at which point the brake shoes are sufficiently worn to require replacement.

After replacement of worn brake shoes, or replacement of one or more lost brake shoes, on the first braking stroke thereafter, when the control lever 124 ceases movement due to its engagement with the end 136A of the movement controlling slot 136 of control bracket 132, the trigger bracket 123 will be short of the trigger housing 125 and the adjuster 104 operates in the manner disclosed in said U.S. Pat. No. 2,669,224 to let out slack to a point that the fulcrum 102 will move to the left of FIG. 3 to reach its normal operating position relative to the brake cylinder and cylinder lever, and at this point the trigger bracket 123 engages the trigger housing 125.

The brake rigging assemblies 52 and 54 operate simultaneously under the control of the conventional air brake equipment involved, to, for each assembly 52 and 54, transmit the braking forces to the brake shoes 163 and 171 while maintaining the fulcrum 102 in operating position such that the brake cylinder thrust rod 62 will be limited in stroke to the range that accords with AAR Regulations.

The rigging assemblies 52 and 54 are arranged to be integrated with the respective stub center sills 20 at either end of the car without requiring perforation of the shear plate 76 in the load bearing areas of same (within the confines of the car side and end walls 12 and 28).

It is also to be noted from the showings of FIGS. 4 through 7 that the operative components of the brake rigging assemblies associated with the stub center sill are located adjacent the center sill neutral axis 56 for minimization of needs to reinforce the center sill structure involved.

SPECIFIC DESCRIPTION

The details of construction of the car 10 follow the general arrangement disclosed in said Teoli U.S. Pat. No. 3,713,400 and further specific details of constructions may be in accordance with specifications of Youngstown Steel Door Co. on the subject.

For purposes of this invention, it is only necessary to understand that the dropped bottom 32 extends substantially the full distance between the area of operation of the car trucks at either end of the car to the extent specifically indicated in FIGS. 3 and 4, and that the dropped bottom and adjacent car wall forming structures are affixed to the respective shear plates 36 that overlie the area of operation of the car trucks at either end of the car, and in addition extend sidewise of the car for connection to the side sills 13 and to the ends of the car where indicated at 36A in FIG. 3. As indicated, the shear plate 36 is affixed to the dropped bottom 32 at its end plate 34 at either end of the car.

The shear plate 36 exteriorily of the car end walls 38 may be safely apertured for passage therethrough of the chain 196 that leads to hand brake 200.

Otherwise, the invention contemplates that all components of the rigging assemblies 52 and 54 will be below the shear plates 36 at either end of the car, and that no apertures will be formed in the shear plate either for application or operation of the rigging components involved. Some of the rigging components are supported by shear plate 36, as by having component supports affixed to the underside thereof by welding, and not by employing bolts or rivets that would require the formation of apertures in the shear plate 36.

The brake cylinder 60 in the form shown is mounted under the shear plate 36 (at both ends of the car) and adjacent the stub center sill side 43 by having its conventional mounting bracket plate 220 suitably affixed to mounting plate 222 and is welded to the center sill side plate 43 as at 224 and has a gusset plate 226 affixed thereto as by welding at 228 for securement to the underside of stress plate 36 by welding as at 230. Suitable bolt and nut assemblies 232 may be employed to removably secure the brake cylinder to mounting plate 222.

The stub center sills 20 themselves comprise the side walls 43 and 45 suitably affixed to the underside of the shear plate 36, as by welding, and extending between the dropped bottom end plates 34 and the end of the car to form the usual draft gear pocket for mounting the usual draft gear and other associated parts sill that resiliently connect the car couplers 40 to the car. The side walls 43 and 45 are each suitably flanged as at 240 and 242, respectively, whereby the center sills define the usual inverted channel shaped transverse cross-sectional configuration that opens downwardly, as indicated by FIGS. 5–8.

The body bolster 18 may be of any suitable design, that illustrated including at each end of the car at the location of the center plate stucture 22 a pair of spaced vertical plates 246 and 248 on either side of the car fixed, as by employing welding, between the shear plate 36, the respective center sill side plates 43 and 45, and lower web plates 249. 48. As indicated in FIGS. 3 and 9, the bolster plates 246 and 248 on the side of the center sill on which the adjuster 104 is mounted are perforated as at 250 to accommodate the extension of the adjuster 104 therethrough for application to anchor bracket 114.

The anchor bracket 114 comprises horizontal plate 252 and vertical plate 254 welded together and to the center sill side plate 45 and shear plate 36, respectively, in the manner suggested in the drawings, to provide a horizontal ledge 256 to which the adjuster member 112 is pivotally connected, as by having clevis 258 suitably secured thereto and receiving pin 260 that is suitably secured through plate 252 (and forms pivotal connection 116).

The cylinder lever 66 is proportioned as suggested in the drawings to extend from its point of connection to the brake cylinder thrust rod 62 through the center sill side wall 43 for fulcruming on the center sill side wall 45 in the manner suggested by FIGS. 3 and 7 wherein upper and lower angle members 82, 84 are affixed by welding to the inside surface of center sill side plate 45 and apertured to receive pivot pin 86 for this purpose.

The floating adjusting lever 90 is proportioned to extend between its connection to cylinder lever rod 94 and the member 110 of the adjuster 104 in the manner suggested by the drawings, with the adjuster means 110 having clevis 264 secured thereto in the manner disclosed in said U.S. Pat. No. 3,669,224 for this purpose, with suitable pin 102 making the pivotal connection at this point.

The cylinder lever rod 94 and the center rod 146 may be in the form of suitable rod elements each equipped with suitable clevises at either end of same suitably fixed in operating position.

The control or trigger lever 124 is suitably apertured to receive the pivot pin 122 that connects same to the trigger rod clevis 270 which may be arranged in the manner suggested in said U.S. Pat. No. 3,669,224. The window opening 98 through which the adjusting lever 90 and the trigger lever 124 extending into the interior of the center sill (see FIG. 6) are proportioned lengthwise of the car to accommodate the necessary movements of these brake rigging members, with the respective supporting angle members 106 and 108 extending longitudinally across the window 98 for fixing to the center plate side 45 as by employing welding.

The floating adjusting lever 90 is slidably supported by carrier 270 (see FIG. 6B) in the form of a rod 272 of square section angled to define U shaped portion 273 with each of its legs 274 and 276 including an angled wing portion 278 that is welded to the underside of the shear plate 36 to dispose the carrier 270 in the positioning indicated in FIGS. 3 and 6.

The U shaped portion 273 of carrier 270 has cross rod 280 fixed thereacross in spaced relation above the bight 282 of the rod 272 to define a slideway 284 through which member 90 extends and in which lever 90 operates in the practice of the invention.

The control bracket 132 is more specifically shown in FIG. 6A and comprises angle member 286 having its flange 288 affixed to the underside of shear plate 36 as by employing welding, to dispose bracket 132 in approximate centered relation with and above carrier 270, as indicated in FIG. 3. The flange 134 of bracket 132 is formed with the aforementioned slot 136 through which the control or trigger lever 124 extends in the manner indicated in FIG. 6.

The vertical lever 142 is mounted in its operating position by support assembly or structure 140 which comprises a pair of spaced apart angle members 290 and 292 (see FIG. 5) fixed between angle member 294 and mounting plate 296 (see FIG. 4), with the angle member 294 being suitably fixed to and between the center sill flanges 240 and 242, and the mounting plate 296 being suitably affixed to the dropped bottom end plate 34, all by employing welding.

The angle members 290 and 292 are suitably apertured to receive pivot pin 298 that forms the vertical member pivot 144.

In the form shown, the upper end 143 of the vertical lever 142 is disposed adjacent the center sill side wall 45, the latter having applied to same the retainer plate 152 that functions to keep the pivot pin 148 in place. Plate 152 has its angled end portion 300 suitably affixed to the dropped bottom end plate 34, as by welding. In this connection, the inner ends 302 of the stub center sills are exicised or relieved as at 304 (see FIG. 4).

Affixed between the angle member and the dropped bottom end plate 34 is a vertical lever guide structure 310 comprising a pair of J shaped plates 312 and 314 disposed on either side of the vertical lever 142 and positioned relative to the vertical lever 142 as shown in FIGS. 4 and 5.

The hook and eye brake rigging arrangement employed to articulate the brake beams 161 and 173 in the rigging may be any suitable type of hook and eye arrangement, with the brake rods, brake levers, and lever connections being of the types made by Schaefer Equipment Company of Warren, Ohio in the illustrated embodiment, and being applied to the truck wheels in a familiar form of under the axle application that needs no further detailing. In the form shown, the anchor lever 182 is mounted under the outer end of the stub center sill by employing bracket structure 186 comprising (see FIG. 8) a pair of spaced apart vertically disposed plates 320 and 322 affixed in depending relation from the center sill respective flanges 240 and 242 and having fixed between same the vertical cross plate 324 and horizontal cross plate 326 between which are affixed by welding the spaced apart lug plates 328 that receive the pivot pin 330 that pivotally mounts the anchor lever 182 in its operative position.

The hand brake rod 190, which may be of any suitable type, is suitably pivotally connected at its end 193, as by employing pivot pin 192, and extends through support device 332 for connection to the chain 196. Support device 332, as shown in FIG. 9, comprises support member 334 having a vertical portion 336 affixed to the shear plate 36 by welding and a horizontal portion 338 affixed to the center sill side plate 43 by welding. At the corner 340 defined by the member 334, brake retainer element 342 is affixed in place, this element comprising J shaped member 344 having its ends 346 and 348 suitably affixed to the member 334 as by employing welding, to define slideway 350 in which the hand brake rod 190 operates.

Chain 196 is trained about suitable pulley 260 journaled by pin 361 in suitable U shaped bracket 362 affixed to the underside of shear plate 36 as by employing welding.

It will therefore be seen that the invention provides a double ended brake rigging arrangement specifically applicable to the special type of gondola car indicated, with the brake rigging at either end of the car being equally integrated with the center sill, and below the car shear plate that is integrated with the center sill, without requiring perforation of the shear plate in the load bearing area of the shear plate. The rigging components involved are applied to the stub center sill adjacent the level of its neutral axis for minimizing sill reinforcement requirements. Slack is taken up at the live end of the rigging, and the levers involved are supported to be held against any substantial shifting movement when the car is inverted for dumping purposes.

The brake rigging arrangement of the invention as applied to the dropped bottom gondola car of the type indicated provides this type of car with the advantages of rigging slack adjustment due to brake shoe wear, loss, and replacement. Other practical considerations involved are that brake shoes employed with rigging of the type hereindisclosed may be two inch shoes, as distinguished from the one and one-quarter inch shoes customarily employed on truck mounted rigging, and the brake cylinders 60 may be in the form of a pair of seven inch diameter cylinders which have the same air operating requirements as a single ten inch diameter cylinder frequently employed in rigging arrangements of the type where a single brake cylinder operates the brake shoes of both car trucks.

The brake adjuster 104 in a specific embodiment of the invention is a 10 inch travel automatic slack adjuster made by the Railroad Products Division of Sloan Valve Co. as its Model No. 5001DJS adjuster.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a dropped bottom gondola car having a car body riding on wheeled trucks at either end of same in which the car body is of gondola container configuration defining a dropped bottom between the trucks, said body having at either end of its dropped bottom a horizontal shear plate fixed thereto and that is substantially coextensive with the car end, said plates each being mounted on top of a stub center sill operably connected to the truck at the respective ends of the car, with the stub sills being aligned along the longitudinal centerline of the car, a brake rigging arrangement therefor wherein the rigging at each car end applies wheel braking forces to the car end truck wheels through brake shoes, with the car end rigging comprising:

a brake cylinder mounted adjacent the dropped bottom at the level of and to one side of the car end center sill, with said brake cylinder having a thrust rod extending longitudinally of the car and directed away from its dropped bottom, with said thrust rod being reciprocably mounted in said cylinder for effecting a thrust stroke, a cylinder lever disposed crosswise of the car and having one end of same pivotally connected to said thrust rod and the other end of same extending into the car end center sill and fulcrumed on the other side of same, a floating lever extending generally crosswise of the car and positioned between the cylinder lever and the dropped bottom and lying in the horizontal plane of the car end sill, said floating lever having a fulcrum adjacent one end of same and located externally of and on the other side of the car end sill, a cylinder lever rod pivotally connected to said cylinder lever intermediate its ends and disposed within the car end center sill, said cylinder lever rod being pivotally connected to said floating lever adjacent the other end of said floating lever and within the car end center sill, a vertical live lever disposed between the floating lever and the dropped bottom and mounted for pivotal movement intermediate the ends thereof about a horizontal axis extending transversely of the car and for movement in a vertical plane that includes the car and center sill, with the vertical lever upper end being disposed adjacent the level of said brake cylinder and within the car end centersill, and means for operably connecting the vertical lever lower end to the car end brake shoes for applying the braking forces to the car end truck wheels on actuation of said brake cylinder to effect said thrust rod stroke, a center rod pivotally connected between said vertical lever upper end and said floating lever intermediate the ends of the latter, means for shifting said floating lever fulcrum longitudinally of the car in slack take up and let out directions for making the thrust stroke of the brake cylinder thrust rod of substantially uniform predetermined length, and means for controlling said shifting means for effecting shifting of said floating lever fulcrum longitudinally of the car to compensate for wear, loss, and replacement of the car end brake shoes.

2. The brake rigging arrangement set forth in claim 1 wherein the rigging at each car end further comprises:

said cylinder lever and said floating lever being disposed adjacent the level of the car end centersill neutral axis.

3. The brake rigging arrangement set forth in claim 2 wherein the rigging at each car end further comprises:

said shifting means being a brake rigging slack adjuster extending longitudinally of the car and located adjacent said other side of the car end center sill and exteriorly thereof, said adjuster comprising:

first and second telescoping members operatively connected between said floating lever fulcrum and the car end center sill, actuator means for causing one of said telescoping members to move relative to the other of said members in a slack take up direction, and control means for controlling the actuation of said actuator means, said control means comprising:

an operating arm swingably connected to said actuator and to said floating lever at the connection thereto of said center rod within the car end centersill, and stop means mounted within the car end centersill for limiting swinging movement of said operating arm at a predetermined stroke of said thrust rod for effecting said telescoping movement of said one adjuster member.

4. The brake rigging arrangement set forth in claim 3 wherein the rigging at each car end further comprises:

said one adjuster member being pivotally connected to said floating lever to form said fulcrum, with the other adjuster member end being anchored to the car body.

5. The brake rigging arrangement set forth in claim 4 wherein the rigging at each car end further comprises:

the other adjuster member end being anchored to the car end centersill on said other side thereof.

6. The brake rigging arrangement set forth in claim 3 wherein the rigging at each car end further comprises:

said brake cylinder being disposed to position said thrust rod adjacent the level of the car end centersill neutral axis, said slack adjuster being disposed to position said members thereof adjacent the level of the car end centersill neutral axis.

7. The brake rigging arrangement set forth in claim 4 wherein the rigging at each car end further comprises:

said adjuster projecting from said floating lever fulcrum away from the dropped bottom.

* * * * *